US012404090B2

(12) United States Patent
Dowell, Jr. et al.

(10) Patent No.: US 12,404,090 B2
(45) Date of Patent: Sep. 2, 2025

(54) STORAGE SYSTEM

(71) Applicants: Steven Clay Dowell, Jr., Moody, TX (US); Steven Clay Dowell, Sr., Moody, TX (US)

(72) Inventors: Steven Clay Dowell, Jr., Moody, TX (US); Steven Clay Dowell, Sr., Moody, TX (US)

( * ) Notice: Subject to any disclaimer, the term of this patent is extended or adjusted under 35 U.S.C. 154(b) by 0 days.

(21) Appl. No.: 19/082,918

(22) Filed: Mar. 18, 2025

(65) Prior Publication Data

US 2025/0236453 A1 Jul. 24, 2025

Related U.S. Application Data

(60) Provisional application No. 63/622,382, filed on Jan. 18, 2024.

(51) Int. Cl.

| | |
|---|---|
| ***B65D 88/02*** | (2006.01) |
| ***B65D 88/00*** | (2006.01) |
| ***B65D 88/52*** | (2006.01) |
| ***B65D 90/02*** | (2019.01) |
| ***B65D 90/18*** | (2006.01) |

(52) U.S. Cl.

CPC ..... *B65D 88/005* (2013.01); *B65D 88/027* (2013.01); *B65D 88/526* (2013.01); *B65D 90/023* (2013.01); *B65D 90/18* (2013.01); *B65D 2590/0066* (2013.01); *B65D 2590/023* (2013.01)

(58) Field of Classification Search

CPC .. B65D 88/005; B65D 88/027; B65D 88/526; B65D 90/023; B65D 2590/0066; B65D 88/022; B65D 21/02; B65D 21/0201; B65D 21/0204

See application file for complete search history.

(56) References Cited

U.S. PATENT DOCUMENTS

| | | | | |
|---|---|---|---|---|
| 6,039,527 | A * | 3/2000 | Myllari | B65D 88/022 414/812 |
| 2019/0257073 | A1* | 8/2019 | Ledoux | B65D 88/027 |
| 2021/0237967 | A1* | 8/2021 | Havener | B65D 19/06 |
| 2021/0339943 | A1* | 11/2021 | Austrheim | B65D 21/0201 |
| 2022/0169440 | A1* | 6/2022 | Zacharia | B65D 21/0209 |
| 2024/0140692 | A1* | 5/2024 | Nylund | B65D 88/022 |

* cited by examiner

*Primary Examiner* — Don M Anderson
(74) *Attorney, Agent, or Firm* — Plager Schack LLP; Mark H. Plager; Naomi Mann

(57) ABSTRACT

A modular container storage system includes multiple container units configured to be assembled to one another in an indefinite expanded state for enabling sheltered access to the stored items through a corridor enclosure, and in a compacted state for convenient transport and/or reduced storage space.

10 Claims, 7 Drawing Sheets

STORAGE SYSTEM

RELATED APPLICATION

This application claims benefit to U.S. Application No. 63/622,382 filed Jan. 18, 2024, which is incorporated by reference herein in its entirety.

BACKGROUND

The present disclosure relates generally to storage systems and more specifically to storage systems that allow for convenient transport.

Maintaining a large number of items in an organized fashion may be challenging, especially when such items need to be transported, e.g., upon moving or traveling. As such, an improved system for conveniently storing multiple items in a manner which allows for easy access and transport is desirable.

SUMMARY

According to various embodiments, disclosed is a storage system, comprising multiple container units configured to assemble to one another, wherein the container assembly can be switched between an expanded (i.e., open) state for enabling access to stored items and a compacted (i.e., closed or collapsed) state for convenient transport and/or reduced storage space. Additionally, in the expanded state, the multiple container units form an enclosed structure including a central walk-in corridor.

In certain embodiments, the storage system may comprise a pair of container units; a pair of corridor panels; and at least one door, wherein the pair of container units, the pair of corridor panels, and the door are configured to switch between an expanded state of assembly and a collapsed state of assembly. In further embodiments, each container unit in the pair of container units includes a casing providing an interior compartment with a front facing opening in each of the container units, each casing being formed from a top wall, a bottom wall opposite the top wall, a first side wall extending vertically between a first side of the top wall and a first side of the bottom wall, a second side wall extending vertically between a second side of the top wall and a second side of the bottom wall, and a rear wall extending vertically between a rear side of the top wall and a rear side of the bottom wall. In certain embodiments, the pair of container units are positioned opposite one another such that the front facing opening in a first container unit of the pair of container units faces the front facing opening in a second container unit of the pair of container units. In the expanded state of assembly the pair of container units are separated at a distance allowing for attachment of the pair of corridor panels between the pair of container units, and wherein one of the pair of corridor panels is coupled between a front edge in the top wall of the first container unit and a front edge in the top wall of the second container unit to form a ceiling structure between pair of container units; the other one of the pair of corridor panels is coupled between a front edge in the bottom wall of the first container unit and a front edge in the bottom wall of the second container unit to form a floor structure between pair of container units; and the door is rotationally coupled proximate a front edge in the first side wall of the first container unit via interlocking hinge components, the door further configured to shut against a front edge in the second side wall of the second container unit. In the collapsed state of assembly, the pair of container units are adjoined to close said distance separating the container units in the expanded state, the adjoined container units having a top enclosure formed by the joinder of the top walls of the first container unit and the second container unit, a bottom enclosure opposite the top enclosure formed by the joinder of the bottom wall of the first container unit and the bottom wall of the second container unit, a first side enclosure formed by the joinder of the first side wall of the first container unit and the second side wall of the second container unit, a second side enclosure opposite the first side enclosure and formed by the joiner of the second side wall of the first container unit and the first side wall of the second container unit, a third side enclosure formed by the rear wall of the first container unit, and a fourth side enclosure opposite the third side enclosure and formed by the rear wall of the second container unit.

In further embodiments, the first container unit and the second container unit are configured to attach to one another side by side, such that the storage system can be expanded to include a multiple number of container unit pairs, which in the expanded state of assembly comprise a first container unit row of multiple first container units attached side by side to one another, and a second container unit row of an equal number of second container units attached side by side to one another, wherein the first container unit row and the second container unit row are positioned opposite one another such that the front facing opening in each of the first container unit faces the front facing opening in an oppositely disposed second container unit. Additionally, the first container unit row and the second container unit row form a corridor enclosure in the expanded state of assembly, the corridor enclosure including a celling and floor structure formed via a multiple pair of corridor panels corresponding to the number of container unit pairs, the system further including two doors which are attached to an entrance side and to an exit side of the corridor enclosure, wherein a user may walk through the corridor enclosure to access any of the container units for placing or removing stored items from the container units.

BRIEF DESCRIPTION OF THE FIGURES

The detailed description of some embodiments of the invention will be made below with reference to the accompanying figures, wherein the figures disclose one or more embodiments of the present invention.

FIG. 1 is a perspective view depicting four assembled container units in the expanded state and with a door component in a closed position, according to certain embodiments.

FIG. 2 shows the assembly of FIG. 1, but with the door component opened.

FIG. 3 is an exploded view of the storage system.

FIG. 4 is a section view along line 4-4 in FIG. 1.

FIG. 5 is a section view along line 5-5 in FIG. 1.

FIG. 6 is a front perspective view of depicting a pair of assembled container units in the compacted state.

FIG. 7 is a rear perspective view of the pair of container units depicted in FIG. 6.

FIG. 8 is a section view along line 8-8 in FIG. 6.

FIG. 9 is a side view showing the pair of assembled container units tilted on integrated wheels.

FIG. 10 is a detailed perspective view of a latch component of the system.

FIG. 11 is a detailed perspective view of a door hinge component of the system.

FIG. 12 is a detailed section view of a cam buckle strap component of the system.

FIG. 13 is a perspective view of the pair container units assembled in the compacted state, and including lift feet.

FIG. 14 is a plan side view of showing stacking of a first and a second pair of container units, both in the compacted state, and supported on the lift feet.

DETAILED DESCRIPTION OF CERTAIN EMBODIMENTS

Figure 1:
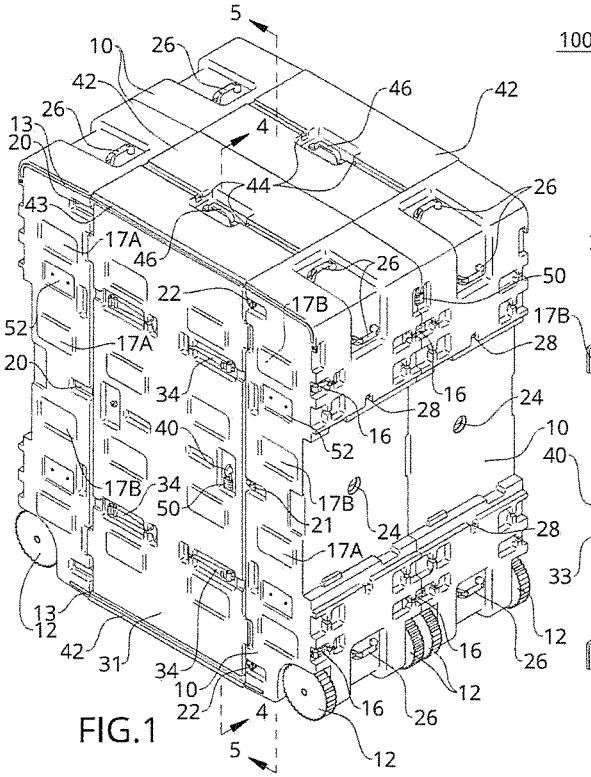
FIGS. 1-14 depict a storage system comprising multiple container units according to certain embodiments, the multiple container units being configured to assemble and be switched between an expanded state of assembly, and a compacted state of assembly.
Figure 2:
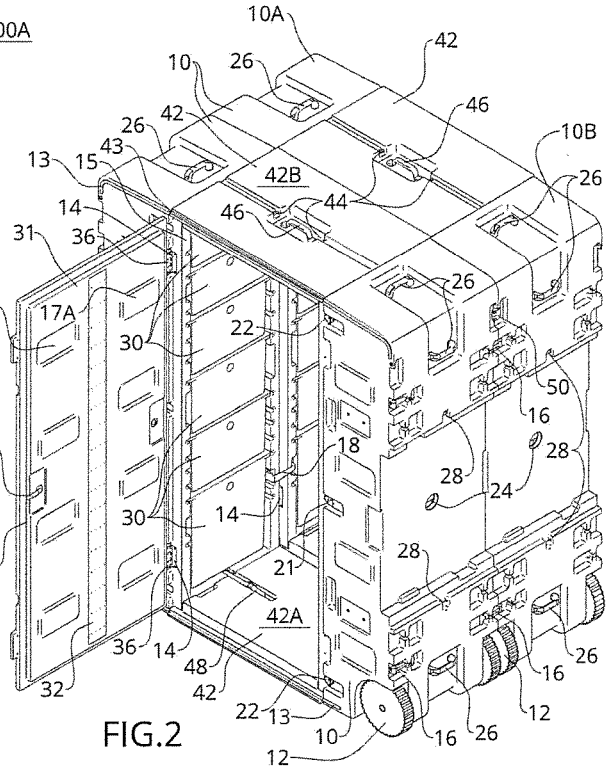
Figure 3:
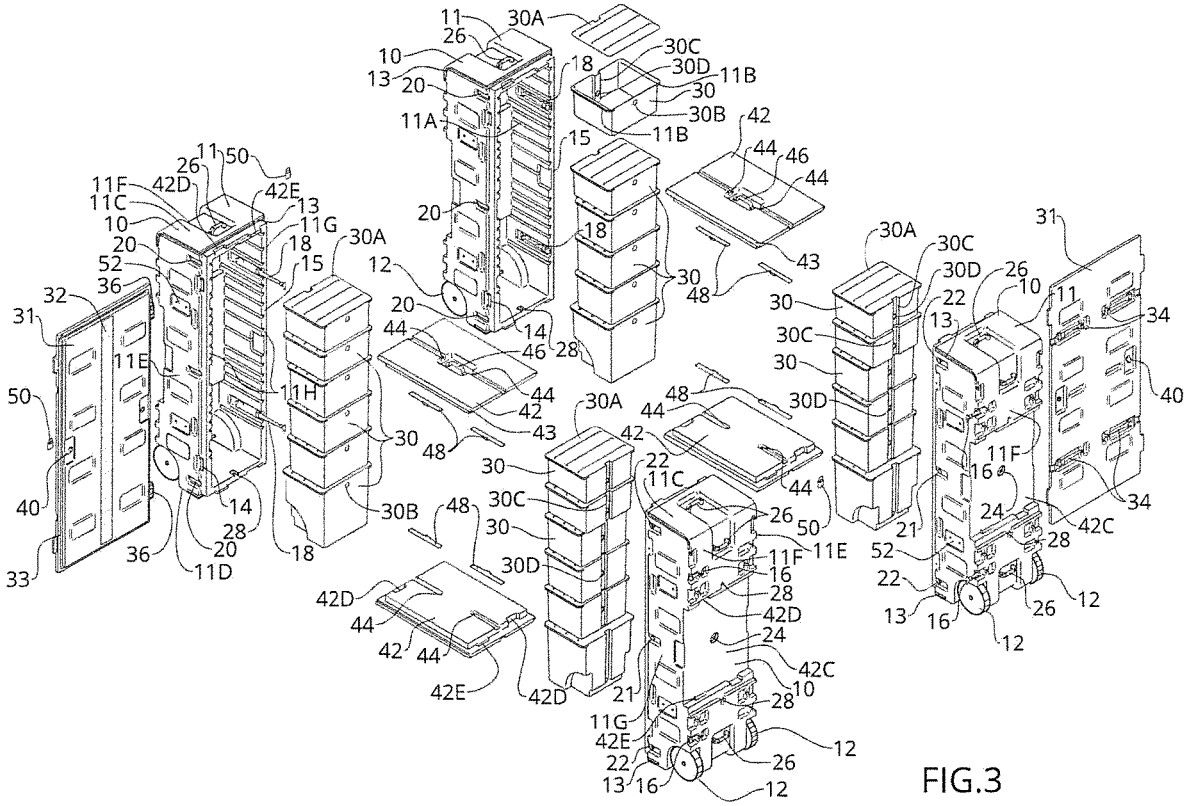
Figure 4:
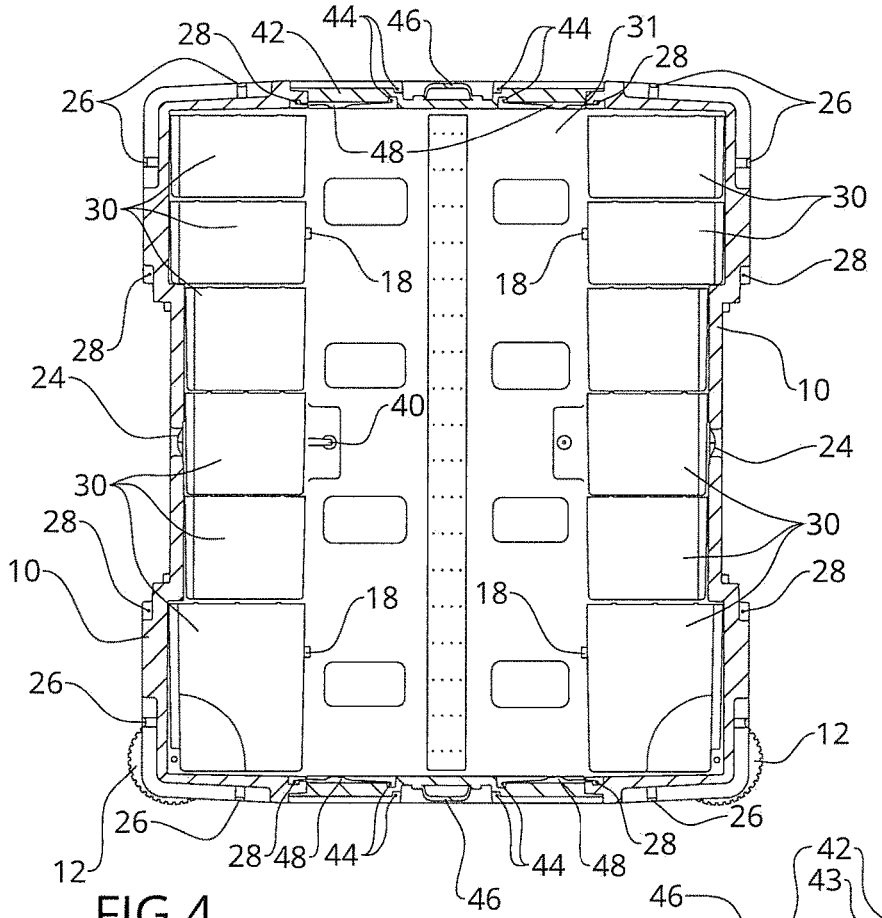
Figure 5:
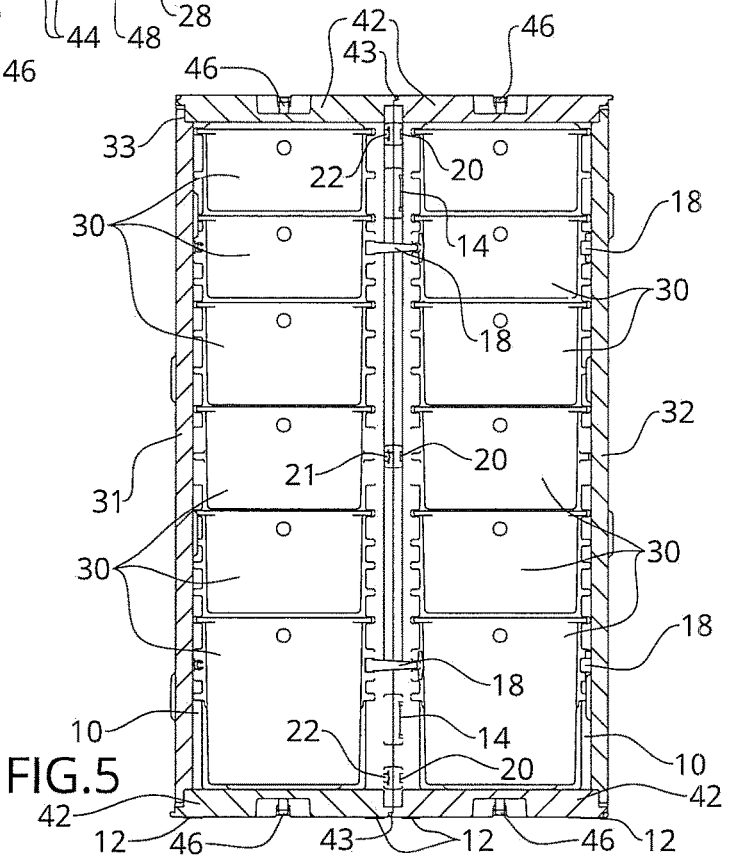

According to various embodiments as depicted in FIGS. 1-14, disclosed is a storage method and/or system 100 for storing various items, comprising multiple container units 10 which may be selectively switched between an expanded assembly 100A for enabling access to the stored items, and a collapsed/compacted assembly 100B for convenient transport and/or reduced storage space. In certain embodiments, the expanded assembly may comprise a first row 10A of one or more container units 10 and a second row 10B of an equal number of container units 10 facing opposite the first row, wherein container units 10 in each row are configured to securely assemble side by side indefinitely. Storage system 100 may further include corridor panels 42 configured to form a floor structure 42A and ceiling structure 42B between the oppositely disposed first and second container rows 10A, 10B, such that a corridor enclosure is formed between rows 10A and 10B. In further embodiments, storage system 100 may provide a pair of doors 31, wherein one door 31 may be assembled over an entrance opening and the other door may be assembled over an exit opening in the formed corridor enclosure when the assembly is in its expanded state, wherein each door may be opened to allow access into the assembled storage system, or locked shut to securely enclose the assembled storage system. As such, storage system 100 allows a user to assemble an unlimited number of container units 10 for forming a storage system of customizable size, which may be compacted for convenient transport, or set up as an enclosed storage space for various items. In the compacted state, the container units 10 are configured to securely attach in a manner which keeps the stored items in placed, so that the items do not need to be removed and repacked. Furthermore, doors 31 and panels 42 are also configured to store compactly with the container units to provide an overall structure which is convenient for transport.

In certain embodiments, each container unit 10 may include a casing 11 generally comprising a top wall 11C, a bottom wall 11D, a first side wall 11E, a second side wall 11G, and a rear wall 11F, which together define an interior compartment with a front facing opening. In embodiments, casing 11 is a unitary molded piece. In some embodiments, casing 11 may include top and bottom weatherstripping 13 and compartment weatherstrippings 15 for a protective water seal in the formed corridor unit. In some embodiments, each casing 11 may be about 50 inches to about 100 inches in vertical length, or about 79.8 inches in vertical length. Each casing 11 may further have a depth of about 10 inches to about 40 inches, or about 19.5 inches. Each casing 11 may further have a width of about 15 inches to about 40 inches, or about 27 inches. It shall be appreciated however that casing 11 may be of any dimensions in alternate embodiments.

In further embodiments, each casing 11 is configured to support a plurality of storage bins 30 that may be slidable into and out of the interior compartment of the casing through the front opening, thus providing storage drawers within casing 11. In some embodiments, each casing 11 may include horizontal slots 11A (i.e., tracks) which may be molded within internal surfaces of side walls 11E, 11G, for slidably receiving side tabs 11B in storage bins 30. In some embodiments, multiple slots 11A may be incrementally spaced throughout the vertical length of casing 11 (e.g., about 1 inch to about 5 inches apart), to allow multiple alternative placement locations for bins 30 and to further allow bins of a variety of different vertical dimensions to be stored in casing 11. In one embodiment, storage bins 30 may each comprise a main bin container (also referred to as "bin container 30") having a top opening and a bin lid 30A configured to enclose the top opening. Bin container 30 and bin lid 30A may each include conforming top side tabs 11B configured to slide into the horizontal slots 11A in casing 11, so that main container 30 may be used with or without lid 30A. In further embodiments, each bin container 30 may comprise a front finger hole 30B and/or a drawer pull knob on a front facing side of the bin. In some further embodiments, each bin container 30 may include a vertical rear channel 30C (e.g., about 1 inch deep) and a bin rear cord cutout 30D in a rear facing side of the bin which provides unobstructed access from each bin interior to container unit 10 inlet/outlets holes 24. It shall be appreciated that different bin/drawer configurations may be used in alternate embodiments.

In certain embodiments, container units 10 are configured to secure to one another side by side to form a row of multiple units in the expanded state, using outer draw latches 16 and inner draw latches 18. In some embodiments, draw latches 16, 18 may comprise rubber latches configured to insert into corresponding recesses in the casings to effectuate a watertight seal while securing the assembled units. In some embodiments, side walls 11E and 11G may comprise mating bumps 17A and depressions 17B at corresponding vertical/horizontal locations, configured to puzzle fit together for assisting in the proper alignment and stable securement of container units when connected side by side in the expanded state and when stacked in the compacted state. In further embodiments, a pair of oppositely facing container units 10 may be secured to one another in the compacted state using a latch component 20 provided on first side wall 11E to securely engage lockable butterfly latches 21 and butterfly latches 22 provided in second side wall 11G at corresponding vertical locations as depicted. In one embodiment, a latch component 20, and butterfly latches 21, 22 may be located within top, middle, and bottom sections of side walls 11E and 11G, respectively, and proximate the front side edges 11H of the casings as depicted, but are not limited to this option. Draw latches 16, 18, corridor panels 42, ratchet straps 48 (i.e., cam buckle straps), latch component 20, and butterfly latches 21, 22 all provide a self-contained attachment mechanism for convenient assembly and conversion between the expanded and collapsed states, which does not require extraneous tools or hardware. It shall be appreciated that different attachment systems and elements may be used in alternate embodiments.

Figure 13:
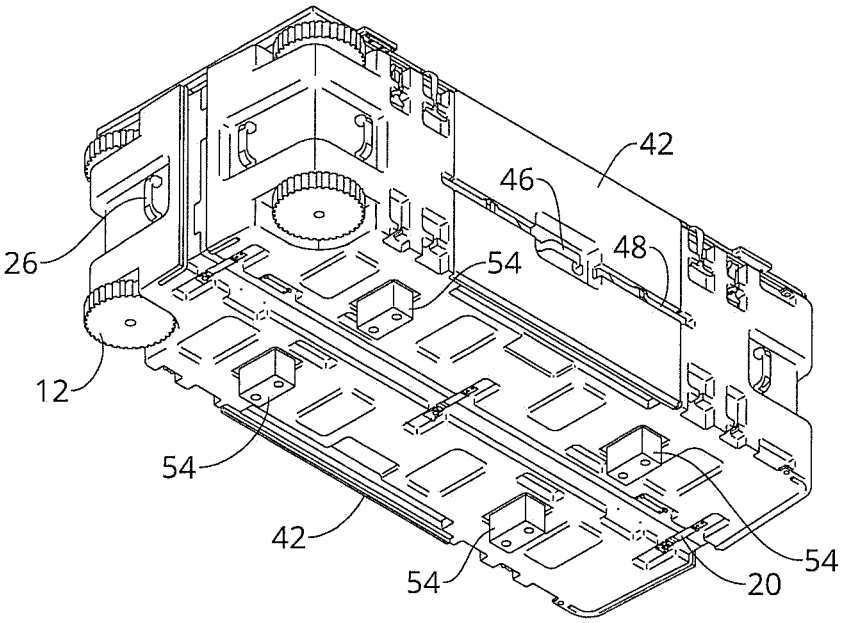
Figure 14:
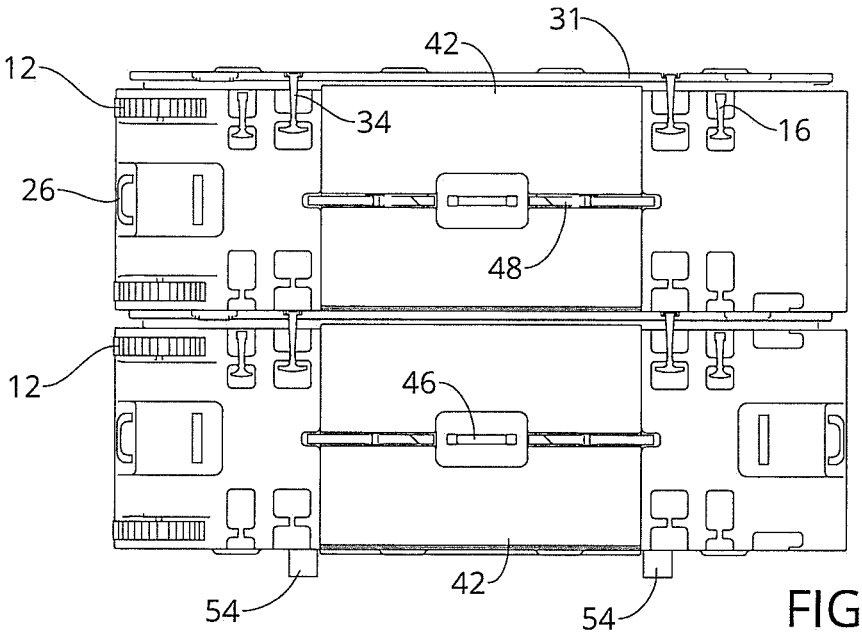

In certain embodiments, each container unit 10/casing 11 may include bottom wheels 12 and handles 26 for facilitating transport. In some embodiments, handles 26 may be provided on the external surfaces of the top and rear walls 11C, 11F, as depicted. In further embodiments, lift foot attachment points 52 may be provided for optional attachment to lift feet 54 (i.e., risers 54) as depicted in FIGS. 13 and 14. As such, a compacted pair of container units 10 may be transported by one or more persons using handles 26 and wheels 12, or one or more compacted pairs may be moved using a forklift and/or risers. It shall be appreciated that any number of wheels, handles, and other types of transport/pull elements may be provided within the walls of casing 11 in alternate embodiments.

In certain embodiments, corridor panels 42 are configured to assemble to the front facing edges of bottom walls 11D and top walls 11C to form floor structure 42A and ceiling structure 42B, respectively, between oppositely disposed container units 10. In certain embodiments, each panel 42 may include ratchet anchor pins 44 which may be disposed proximate a remote end within centrally extending lateral channels in each panel 42, as depicted. Additionally, anchor pins 28 may be disposed within central grooves proximate front facing edges in bottom walls 11D and top walls 11C. Thereby, ratchet straps 48 (i.e., cam buckle straps) may be coupled between anchor pins 28 and ratchet anchor pins 44 to couple panels 42 between each pair of opposing container units 10 to form floor and ceiling structures 42A, 42B. In further embodiments, system 100 may be configured to compactly store panel 42 in the compacted state. In one embodiment, back walls 11F may each include a recessed section 42C configured to receive a panel 42, and anchor pins 28 above and below recessed section 42C as shown. As such, each panel 42 may be attached to the back wall of one of casings 11 by using straps 48 coupled between anchor pins 28 in back wall 11F and ratchet anchor pins 44 in the panel 42 for secure storage in the compacted state. In some embodiments, each panel 42 may include depressions 42D and tabs 42E configured to puzzle fit into corresponding tabs and depressions in the top and bottom front facing edges in casing 11 (for attachment in the expanded sate), and in the back walls 11F (for attachment in the collapsed state). In certain embodiments, each panel 42 may include weather-stripping 43 along its edges for providing a protective water seal in the formed corridor unit. In some further embodiments, each panel may include one or more handles 46. It is noted that the above-described attachment systems for the panels is self-contained, allowing the panels to be assembled in either the expanded or collapsed state without extraneous tools and/or hardware. It shall be appreciated that panels 42 may have different configurations, including attachment and storage mechanisms in alternate embodiments, as well as optional ancillary components for secondary functionality.

Figure 11:
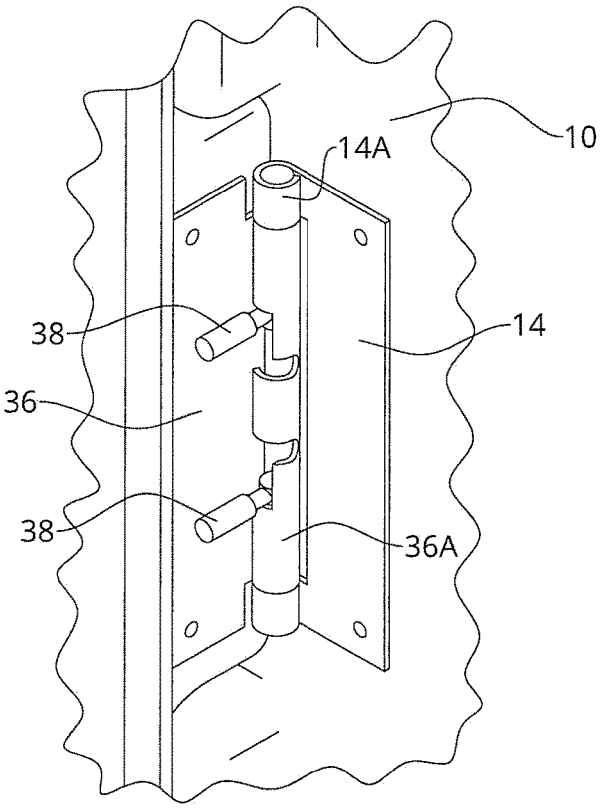
Figure 12:
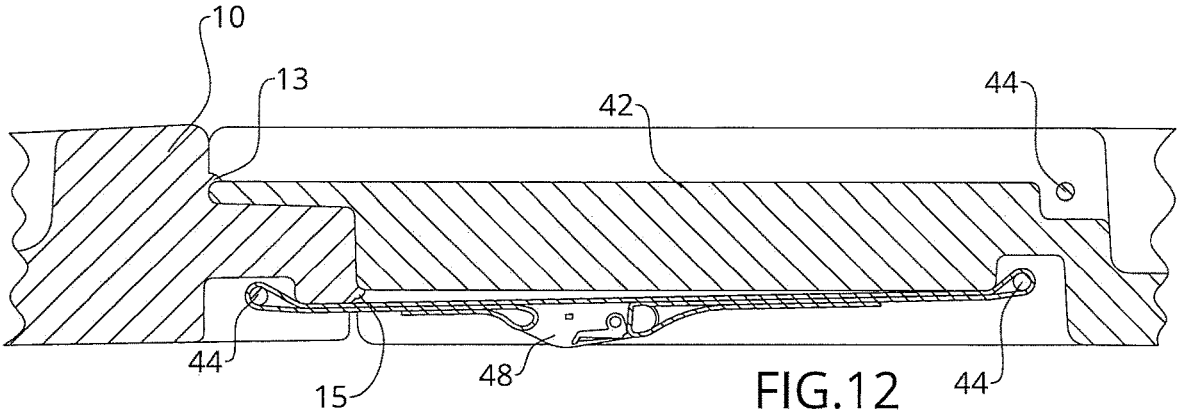

In certain embodiments, storage system 100 includes door attachment and locking elements that enable doors 31 to be functionally attached and locked to container units 10 when assembled in the expanded state, so that doors 31 may enclose over the entrance opening and/or the exit opening in the formed corridor enclosure. In one embodiment, a first side edge of each door 31 may be provided with first hinge halves 36 configured to mate and assemble to second hinge halves 14 provided proximate a front side edge in casing 11 in each container unit 10, the first and second hinge halves being located at corresponding vertical positions along the door and casing edge, respectively. In certain embodiments, first hinge half 36 may comprise a slotted tube 36A and pins 38 slidably supported within tube 36A; second hinge half 14 may comprise a sectioned bracketing tube 14A including top and bottom sections, configured to coaxially assemble to tube 36 as depicted in FIG. 11. Pins 38 may slide into top and bottom sections of tube 14A to secure first and second hinge halves 36, 14, and may be slid out of tube 14A to disengage the hinge halves. It shall be appreciated that different door attachment systems may be used in alternate embodiments; for example, squeeze-release quick-disconnect hinges may be provided in alternate embodiments, which enable doors to be spring snapped into receiving holes, which does not require extraneous tools or hardware.

In further embodiments, a door latch 40 may be provided at a front side of door 31 and is configured to lock shut and securely enclose the assembled storage system provided proximate a front side edge in casing 11 at corresponding vertical positions along the door and casing edges. A padlock 50 inserted within a locking slot in door latch 40 to securely lock the door. It shall be appreciated however that different types of door-locking devices and systems may be used in alternate embodiments. In certain embodiments, hinge halves 14 may be provided in first side wall 11E, and butterfly latch 21 may be in second side 11G of casing 11. As such, when container units 10 and/or rows of multiple container units are positioned facing one another (i.e., to form opposing first container unit row 10A and second container unit row 10B), the door attachment site is provided on the entrance side in first container unit row 10A and the lock engagement site is on the entrance side in the second container unit row 10B; while at the exit side, the door attachment site is in the in second container unit row 10B, and the lock engagement is in the first container row 10A. As such, system 100 may include 2 doors 31 which may optionally be used to lock the entrance and exit openings in an assembly of units in the expanded state.

Figure 6:
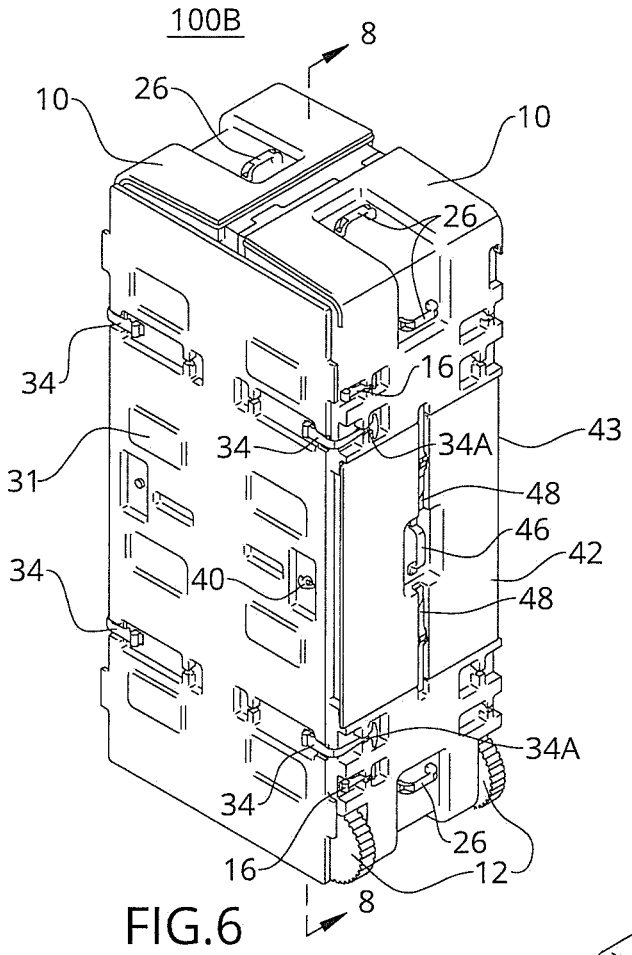
Figure 7:
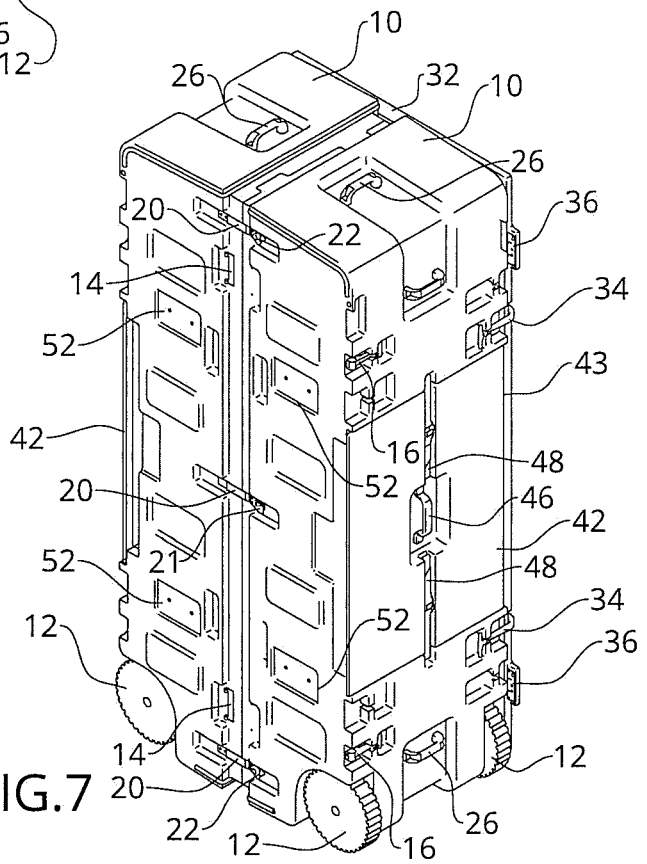
Figure 8:
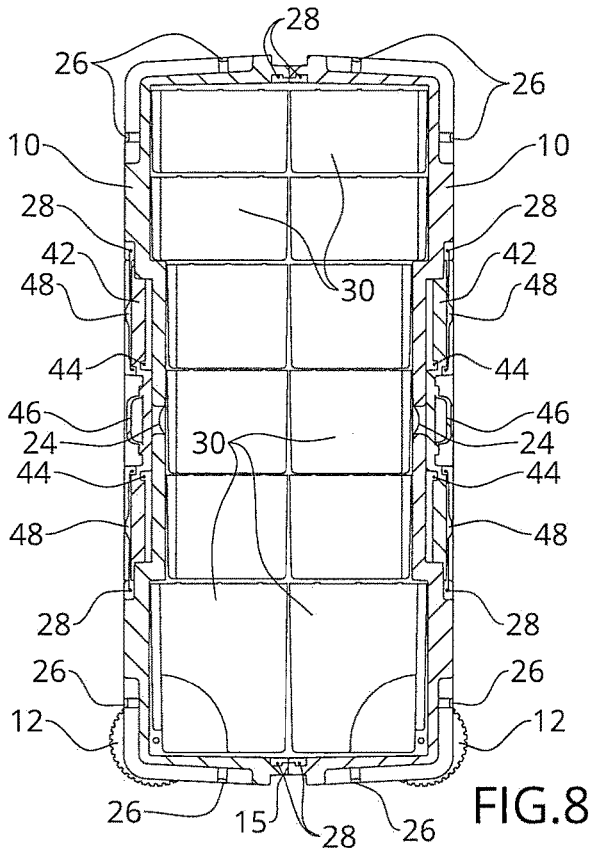
Figure 9:
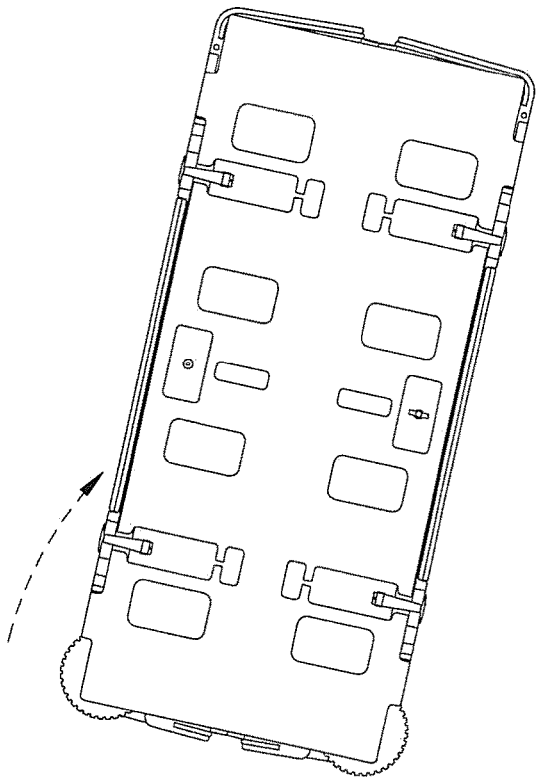
Figure 10:
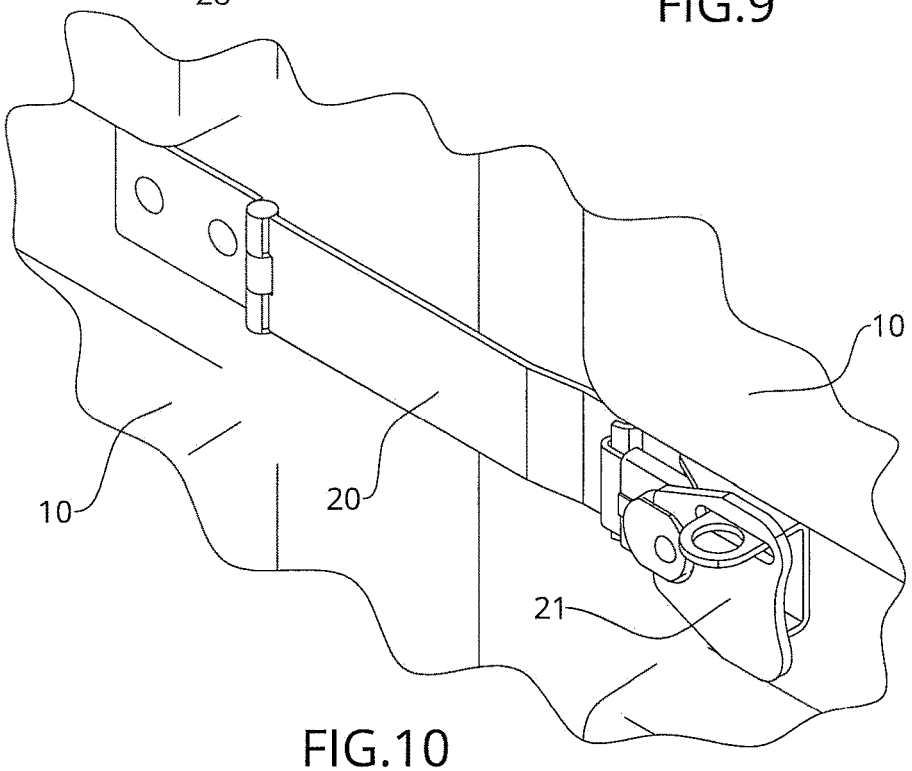

In switching to the compacted state, door(s) 31 are disassembled and removed from the expanded assembly. In certain embodiments, each door 31 may be configured to assemble to system 100 when in the compacted/collapsed state, via a door storage system. Specifically, when container units 10 on opposing sides are collapsed together, door storage system enables door 31 to secure against a surface formed by the unity of side walls 11E and 11G on both entrance and exit sides of the collapsed container assembly. In certain embodiments, the door storage system may comprise using draw latch 34 coupled to door 31 which securely connect to receiving locking elements 34A provided within rear walls 11F. Additionally, door 31 has a width which is approximately twice the depth of each casing 11 (as well as a vertical length approximately equal to that of the casings 11), such that when the two container units 11 are collapsed together, door 31 substantially covers the combined side walls 11G, 11E as best depicted in FIG. 6. In further embodiments, each door 31 may comprise bumps 17A and depressions 17B configured to puzzle mate to the bumps and depressions in side walls 11E and 11G when placed over the combined side walls 11G, 11E, for assisting in the proper alignment and stable securement of door 31. As such, doors 31 may be attached against the side walls of the container units when in the collapsed state for convenient packing. Door may further provide reinforcement to holding the container units together, and further covers the butterfly latches and padlock to protect these components from impact. When expanded, the door is removed, then reattached via the hinges. The above-described door attachment and door storage systems are self-contained and require no extraneous tools/hardware. In some embodiments, each door 31 may include weatherstripping 33 along its edges for providing a protective water seal in the formed corridor unit. In some embodiments, doors 31 may include a hook spine 32 as depicted to provide an attachment point for convenient installation of hooks, mounts, brackets, and/or other various wall storage devices, which does not require extraneous drilling or alteration. It shall be appreciated that doors 31, and the door attachment and storage systems may have different attachment components and configurations in alternate embodiments.

In some embodiments, inlet/outlet holes 24 may be provided, e.g., within rear wall 11F for enabling electrical, water, and/or air/ventilation lines to run into the container unit assembly. Such lines may run between inlet/outlet holes 24 through the vertical rear channel 30C and bin rear cord cutout 30D and front finger hole 30B into bin(s) 30, or around/past the bin(s).

According to an exemplary embodiment, components of storage system 100 (i.e., casings 11, bins 30, panels 42, doors 31) may generally comprise a high-density polyethylene (HDPE) with a thickness of 0.15 inches which may be made via a molding process, such as rotational molding. In one embodiment, casings 11 may each comprise two stainless steel rods with a diameter of 0.25 inches that are over molded into each component during the rotational molding process. An optional foam insulation may be injected into predesigned cavity walls in the components. In further embodiments, other system components such as handles, latches, each may be attached with bolts, rivets, and other appropriate hardware. In some embodiments, wheels 12 may comprise 10 inch plastic wheels, and weatherstripping material may be approximately ½ inch wide. According to an exemplary embodiment, an assembled pair of container units 10 with the HDPE thicknesses described weighs approximately 320.23 pounds and offers a total storage capacity of 18.82 cubic feet with bins installed or 21.5 cubic feet without bins. Such assembly may have packing dimensions of 79.8 inches×38.9 inches×27.0 inches (H×W×L), wherein the width of the assembly increases from 38.9 inches to 70.0 inches in the expanded configuration. It shall be appreciated that the components of system 100 may comprise any alternative known materials in the field and be of any size and/or dimensions. It shall be appreciated that the components of system 100 may be manufactured and assembled using any known techniques in the field.

Hence, system 100 easily converts between the expanded state to the compacted state while holding the stored items so that the items do not need to be removed and repacked. In the compacted state, attachment elements 20, 21, and 22 secure a pair of compartment units against one another to prevent stored items/bins 30 from falling out, and further hold the ceiling/floor panels 42 and doors 31 together with the unit. The pair of compartment units 10 may be placed in the expanded state by disengaging the attachment elements 20, 21, and 22 and pulling apart the pair of compartment units 10. Thereafter, panels 42 are removed from their respective storage locations, i.e., recesses 42C in compartment units 10, by undoing cam-buckle-straps 48. The panels 42 may then be placed between the two storage compartment halves, i.e. 10A and 10B, and secured using same cam-buckle-straps 48 to form a roof and floor structure in the expanded assembly. Optionally, one or more pairs of opposite compartment units which are assembled in the same fashion may be attached to the initially assembled compartment unit pairs using draw latches 16 and 18 which may be recessed rubber latches which aid in waterproofing through high pressure connected seals of the top and bottom weatherstripping 13 and compartment weatherstrippings 15 for a protective water seal in the formed corridor unit. As such, the length and storage capacity of the assembled system 100 may be extended indefinitely. Additionally, doors 31 may be installed at exit and entrance openings in the expanded assembly. The installed doors may be locked shut using a padlock 50 inserted within a locking slot 40. In expanded/open configuration a user can open any one of the doors and walk into the corridor formed between the compartment units. Once standing inside, the user can place or remove items from the storage bins 30 which can be slid in and out of the compartment units along horizontal slots 11A (i.e., tracks). In some optional embodiments, electrical, water, air, or any various utilities can be run into the container using inlet/outlet holes 42 on the sides of each container units and run through the vertical rear channel 30C and bin rear cord cutout 30D and front finger hole 30B into bin(s) 30, or around/past the bin(s). When in the collapsed state, each pair of compartment units can then be hand carried, wheeled, or forklifted to the desired transportation device or repositioned indoors or outdoors as needed, without needing to repack or reorganize the stored items/equipment.

As such, the disclosed system provides a storage assembly which may be hand-carried and converts into a walk-in shipping/transport container which may be used both indoors and outdoors. In embodiments, the compacted assembly fits through doorways, windows, stairways, in basements, garages, etc., and is water sealed to withstand adverse weather when placed outdoors. The system includes connecting compartments that enable the storage space to be increased indefinitely to suit all storage needs, with bins that are tightly secured eliminating movement during transport, and expands into an open configuration (allowing the user to walk inside through the detachable/connectable door(s)). In the closed/compacted configuration, one or more individuals may either pickup and roll the system on wheels, or transport the system using a forklift. Furthermore, due to the rectangular configuration, the system is easily stackable for ease of transport in vehicles, aircraft, ships, intermodal containers, and may also be transported as a shipping container itself and palletized. When arriving at the destination(s), the compacted assembly can be expanded and put into use as a walk-in shelter and storage container immediately with all equipment where it was left on departure. Thus, a user may avoid manual repacking as items stay in place during transport and nearly completely replaces the need to reorganize items upon arrival to any destination. The system further eliminates the need to use boxes, and other disposable storage systems that are commonly discarded after moving, thus further being beneficial in reducing operating expenses and waste.

The disclosed system may be particularly useful for professionals with high volumes of specialized equipment and uniforms, providing a highly organized and convenient means of storage and hassle-free transport. Additionally, individuals seeking to move domestically or overseas may easily transport their belongings without cardboard boxes, wooden crates, and other containers which are susceptible to damage due to weather, crushing/smashing, and damage enroute and lastly creates rubbish and debris after being unpacked at the destination.

It shall be appreciated that the disclosed system and/or components of the disclosed system may have different configurations in alternate embodiments. For example, in some alternate embodiments, the system may be configured to include additional accessories or functional components. Additionally, different designs for the bins, doors, walls, inlet/outlets, latches, handles, etc. may be used in alternate embodiments. In some alternate embodiments, system 100 may be configured to include additional inlet/outlets, internal separating doors, insulation installed into the wall cavities, etc. It shall be appreciated that the disclosed system may be adapted for other uses in alternate embodiments. Such alternate uses may include, but are not limited to an indoor farming/gardening system (e.g., for hydro/aquaponic and vertical farm growing/harvesting), a mobile modular home system, a secured long term storage system, a medical storage system (e.g., for blood and human specimens), a food storage system, amongst others. Additionally, the disclosed system may be beneficial for use in disaster relief, first responder readiness/response, combat ready force deployments in conflict or training, and expeditionary/exploratory missions in austere or off-world environments.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A storage system, comprising:

a pair of container units;

a pair of corridor panels; and a door, wherein the pair of container units, the pair of corridor panels, and the door are configured to switch between an expanded sate of assembly and a collapsed state of assembly, wherein each container unit in the pair of container units includes a casing providing an interior compartment with a front facing opening in each of the container units, each casing being formed from a top wall, a bottom wall opposite the top wall, a first side wall extending vertically between a first side of the top wall and a first side of the bottom wall, a second side wall extending vertically between a second side of the top wall and a second side of the bottom wall, and a rear wall extending vertically between a rear side of the top wall and a rear side of the bottom wall, wherein the pair of container units are positioned opposite one another such that the front facing opening in a first container unit of the pair of container units faces the front facing opening in a second container unit of the pair of container units, wherein in the expanded state of assembly the pair of container units are separated at a distance allowing for attachment of the pair of corridor panels between the pair of container units, and wherein:

one of the pair of corridor panels is coupled between a front edge in the top wall of the first container unit and a front edge in the top wall of the second container unit to form a ceiling structure between pair of container units, the other one of the pair of corridor panels is coupled between a front edge in the bottom wall of the first container unit and a front edge in the bottom wall of the second container unit to form a floor structure between pair of container units, and the door is rotationally coupled proximate a front edge in the first side wall of the first container unit via interlocking hinge components, the door configured to shut against a front edge in the second side wall of the second container unit, wherein in the collapsed state of assembly, the pair of container units are adjoined to close said distance separating the container units in the expanded state, the adjoined container units having a top enclosure formed by the joinder of the top walls of the first container unit and the second container unit, a bottom enclosure opposite the top enclosure formed by the joinder of the bottom wall of the first container unit and the bottom wall of the second container unit, a first side enclosure formed by the joinder of the first side wall of the first container unit and the second side wall of the second container unit, a second side enclosure opposite the first side enclosure and formed by the joiner of the second side wall of the first container unit and the first side wall of the second container unit, a third side enclosure formed by the rear wall of the first container unit, and a fourth side enclosure opposite the third side enclosure and formed by the rear wall of the second container unit.

2. The storage system of claim 1, wherein in the collapsed state, the door and the pair of corridor panels are configured to store flatly against the adjoined container units, and within dedicated storage spaces therein.

3. The storage system of claim 2, wherein a recess for receiving one of the pair of corridor panels is provided in each rear wall in the first and second container units.

4. The storage system of claim 2, wherein the door is configured to overlay the first side enclosure or the second side enclosure for storing flatly against the adjoined container units, wherein the door and each of the first and second side enclosures include mating bumps and depressions so that the surface of the door is configured to puzzle fit with the surface of the first side enclosure and with the surface of the second side enclosure.

5. The storage system of claim 1, further comprising a second door, which is rotationally coupled proximate a front edge in the second side wall of the first container unit via interlocking hinge components, the second door configured to shut against a front edge in the first side wall of the second container unit.

6. The storage system of claim 1, the system including self-contained attachment components for attachment of the door and corridor panels in both the expanded state of assembly and in the collapsed state of assembly.

7. The storage system of claim 1, wherein the first container unit and the second container unit are configured to attach to one another side by side, such that the storage system can be expanded to include a multiple number of container unit pairs, which in the expanded state of assembly comprise a first container unit row of multiple first container units attached side by side to one another, and a second container unit row of an equal number of second container units attached side by side to one another, wherein the first container unit row and the second container unit row are positioned opposite one another such that the front facing opening in each of the first container unit faces the front facing opening in an oppositely disposed second container unit.

8. The storage system of claim 7, wherein the first container unit row and the second container unit row form a corridor enclosure in the expanded state of assembly, the corridor enclosure including a celling and floor structure formed via a multiple pair of corridor panels corresponding to the number of container unit pairs, the corridor enclosure further enclosed via an entrance side door and an exit side door of the storage system, wherein a user may walk through the corridor enclosure to access any of the container units for placing or removing stored items from the container units.

9. The storage system of claim 1, further comprising storage bins that are slidable into and out of the interior compartment through the front opening in each container unit.

10. The storage system of claim 1, further comprising weatherstripping material in the pair of container units, the pair of corridor panels, and the door for providing a sealed enclosure in both the expanded sate of assembly and the collapsed state of assembly.

* * * * *